US008925899B2

(12) United States Patent
Aristi Artolazabal

(10) Patent No.: US 8,925,899 B2
(45) Date of Patent: Jan. 6, 2015

(54) HYDRAULIC JACK WITH LOCKING

(75) Inventor: Juan Martín Aristi Artolazabal, Berriz (ES)

(73) Assignee: Melchor Gabilondo, S.A., Berriz (Bizkaia) (ES)

( * ) Notice: Subject to any disclaimer, the term of this patent is extended or adjusted under 35 U.S.C. 154(b) by 565 days.

(21) Appl. No.: 13/321,264

(22) PCT Filed: May 18, 2010

(86) PCT No.: PCT/ES2010/000216
§ 371 (c)(1),
(2), (4) Date: Nov. 18, 2011

(87) PCT Pub. No.: WO2010/133727
PCT Pub. Date: Nov. 25, 2010

(65) Prior Publication Data

US 2012/0068134 A1 Mar. 22, 2012

(30) Foreign Application Priority Data

May 19, 2009 (ES) ..... 200901246

(51) Int. Cl.
*B66F 3/30* (2006.01)
*B66F 5/04* (2006.01)

(52) U.S. Cl.
CPC ..... *B66F 5/04* (2013.01)
USPC ..... 254/93 H; 254/2 B

(58) Field of Classification Search
CPC ..... B66F 3/24; B66F 3/16; B66F 3/08; B66F 5/04; E21D 15/44; E02B 17/0818
USPC ..... 254/93 H, 89 H, 2 B, 7 B, 134, 8 B, 10 B
See application file for complete search history.

(56) References Cited

U.S. PATENT DOCUMENTS

| | | | | |
|---|---|---|---|---|
| 5,221,073 | A * | 6/1993 | Shockley | 254/8 B |
| 5,618,029 | A * | 4/1997 | Chung | 254/8 B |
| 8,066,259 | B2 * | 11/2011 | Fang et al. | 254/8 B |
| 8,297,595 | B2 * | 10/2012 | Shen et al. | 254/93 R |
| 8,632,055 | B2 * | 1/2014 | Lee et al. | 254/8 B |
| 8,662,476 | B2 * | 3/2014 | Weddle | 254/93 H |
| 2008/0111117 | A1 | 5/2008 | Wu | |
| 2012/0068134 | A1 * | 3/2012 | Aristi Artolazabal | 254/93 H |

FOREIGN PATENT DOCUMENTS

| | | |
|---|---|---|
| DE | 8615503 U1 | 9/1986 |
| GB | 2183598 A | 6/1987 |

* cited by examiner

*Primary Examiner* — Lee D Wilson
(74) *Attorney, Agent, or Firm* — Browdy and Neimark, PLLC

(57) ABSTRACT

A hydraulic jack is provided, with a main body and an articulated lifting arm, provided with safety mechanisms so that the jack load does not fall in the event of hydraulic failure. The jack includes a lever member that turns in relation to the main body, operated by a spring in a locking direction and operable in an unlocking direction by an operable area. The lever member includes a first curved area and a second curved area separated by a step. The lifting arm includes a rotating stop member capable of rolling along the first curved area or the second curved area when the lifting arm rotates, and which lodges itself in the step in order to lock the lifting arm and prevent it from rotating in a descending direction.

3 Claims, 1 Drawing Sheet

HYDRAULIC JACK WITH LOCKING

TECHNICAL FIELD

The invention relates to a hydraulic jack of the type used in garages to lift vehicles.

PRIOR ART

Hydraulic jacks are very common devices that are used to lift up motor vehicles in garages so that they may be checked or repaired. Hydraulic jacks are commonly used in the following way: part of the jack is inserted underneath the vehicle; a lever on the jack is operated, thereby raising a lifting arm on the jack and bringing it into contact with the underside of the vehicle; the continued operating of the lever causes said lifting arm to exert a force in an ascending direction on the underside of the vehicle, causing it to lift up; when the vehicle reaches the required height, trestles or other supports are inserted beneath it and the jack is removed. Said supports keep the vehicle in an elevated position until it needs to be lowered, at which point the jack is inserted once more and the process is repeated in reverse.

It is interesting that hydraulic jacks such as the one described above do possess some type of lodging system or mechanism that allows the jack to support the vehicle once it has been raised, thereby guaranteeing safety in the event that a hydraulic fault in the jack should cause the load to descend suddenly before the trestles or supports can be put in position, with the subsequent danger that would entail. It is convenient, therefore, that the jack is provided with a lodging mechanism that allows the lifting arm to be locked in a certain position so that the arm cannot descend. Said locking must also be sufficiently strong and robust to ensure that the lodged arm can support the position of the vehicle without being dislodged.

The prior art contains known examples of hydraulic jacks provided with lodging means. For example, the jack disclosed in GB2183598A is provided with a lifting arm that has a toothed disc attached to it, which engages with a cable-operated rotating support, with the result that the rotating support may lock the lifting arm in different positions or heights depending on which tooth in the toothed disc it is lodged in. In addition, U.S. Pat. No. 5,618,029 refers to a hydraulic jack with lifting arm, from which extends another articulated arm that engages at one end with the row of teeth of a straight toothed base as the lifting arm moves upwards. Patent application US20080111117 shows a similar hydraulic jack to the preceding one and in which an articulated arm extends from the lifting arm and engages with the row of teeth on a curved toothed piece. These designs are not widely known on the market, which is most probably due to the fact that they are excessively complex, making their manufacture more difficult and expensive.

The present invention aims to provide a design for a hydraulic jack with lodging means that represents an alternative to the preceding ones, the aim being to make the product easier and cheaper to manufacture and, at the same time, to ensure that the lodging means behave in a robust, safe and reliable manner.

BRIEF DESCRIPTION OF THE INVENTION

It is an object of this invention to provide a hydraulic jack, provided in the same way as conventional hydraulic jacks with a main body and a lifting arm that is articulated in relation to the main body and operated hydraulically, and which ends in a pusher endpusher end designed to be raised while pushing a vehicle in an ascending direction. The hydraulic jack of the invention comprises lodging means, which comprise a lever member into which a stop member comprised in the lifting arm is lodged. In more specific terms, the hydraulic jack comprises a lever member that may rotate in relation to the main body in a locking direction or in an unlocking direction and which is operated by a spring in the locking direction. The lever member presents, on one end, an area that is operable (preferably by means of a user's foot) to allow the lever member to be rotated in an unlocking direction. On the other end, the lever member comprises a first curved area and a second curved area, both of them separated by a step that acts as a lodging area. The lifting arm also comprises a rotating stop member designed to roll along the first curved area or the second curved area when the lifting arm rotates. Also, said rotating stop member is capable of lodging itself in the step in order to lock the lifting arm and prevent it from rotating in a descending direction.

As a result, the invention provides a simple and effective lodging mechanism. The mechanism is simple in that it may be based solely on one articulated piece (in the event that the lever member is manufactured as a single piece) that is lodged in a member of the articulated arm (the rotating stop member). It is efficient in that it allows to easily lock the articulated arm in its upper position, to maintain said locking in a solid manner and to easily unlock the lifting arm when required.

BRIEF DESCRIPTION OF THE DRAWINGS

Details of the invention can be seen in the accompanying non-limiting figures.

DETAILED DISCLOSURE OF THE INVENTION

Figure 1:
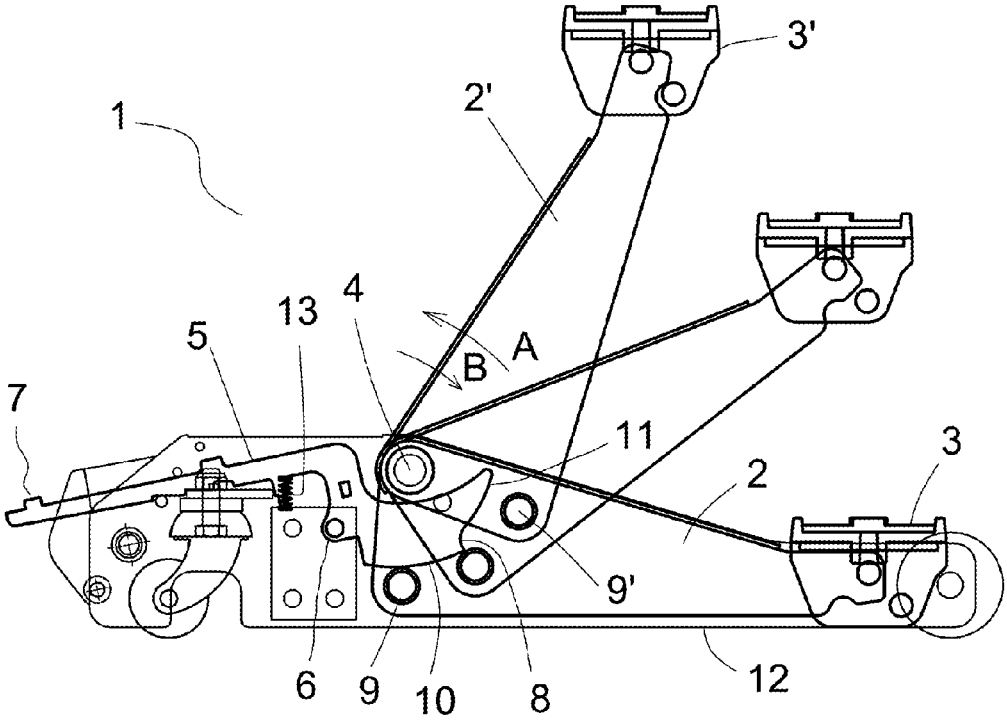
FIG. 1 shows the preferred embodiment of a hydraulic jack according to the invention, with the lifting arm dislodged or unlocked.

FIG. 1 shows the preferred embodiment of the invention, which consists of a hydraulic jack (1) that comprises a main body (12) and a lifting arm (2). The lifting arm (2) is articulated in relation to the main body (12) by means of a knuckle joint (4). The lifting arm (2) is designed, specifically by means of a pusher end (3), to be raised while pushing a vehicle in an ascending direction. Said lifting arm (2) is operated hydraulically and is rotated when the user operates a lever, not shown in the figures.

In accordance with the invention, the hydraulic jack (1) comprises a lever member (5) that is able to rotate in relation to the main body (12) by means of a knuckle joint (6). Said rotation may occur in a locking direction (B) or in an unlocking direction (A). In addition, the lever member (5) is operated by a spring (13) in the locking direction (B). Furthermore, said lever member (5) presents an operable area (7) on one end to allow it to be rotated in the unlocking direction (A). The lever member (5) also comprises a first curved area (10) and a second curved area (11) on the other end, both of them separated by a step (8). The lifting arm (2) and the pusher end (3) are shown in three positions: a lower position, an intermediate position (with dotted lines) and an upper position (indicated by the references 2' and 3' respectively).

As the Figure shows, the lifting arm (2) comprises a rotating stop member (9) designed to roll along the first curved area (10) or the second curved area (11) when the lifting arm (2) rotates, and designed to lodge itself in the step (8) in order to lock the lifting arm (2) and prevent it from rotating in a descending direction. The spring (13) keeps the lever member (5) (more specifically one of the areas (8, 10, 11)) in contact with the rotating stop member (9).

Figure 2:
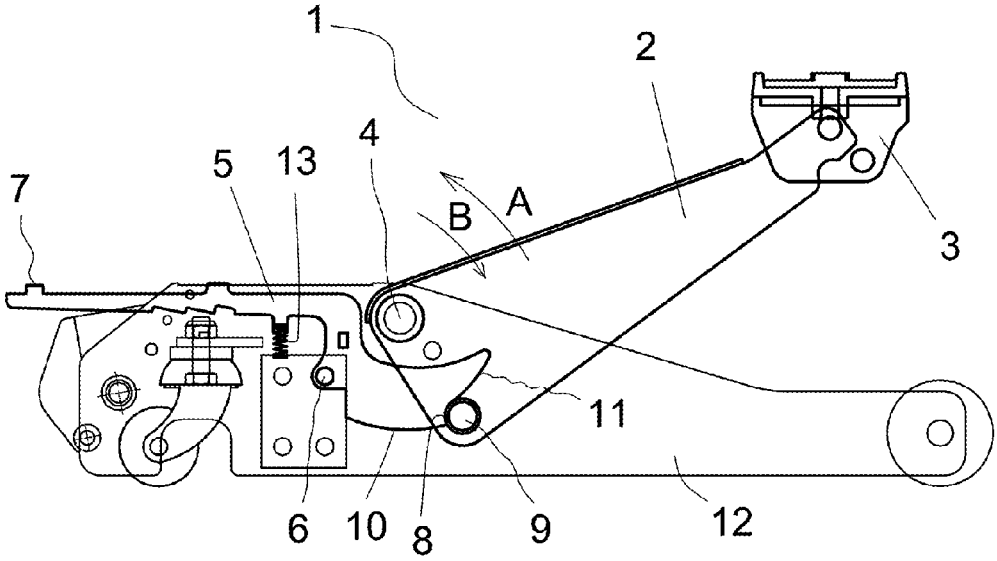
FIG. 2 shows the hydraulic jack of FIG. 1, with the lifting arm lodged or locked.

The operating sequence for the hydraulic jack (1) of the invention is as follows. To begin with, the lifting arm (2) is in its lowest position shown in FIG. 1. In this situation, the lever member (5) is rotated in such a way that the first curved area (10) is in contact with the rotating stop member (9). Then, if the user starts acting on the lever operating the jack (not shown in the figures), the lifting arm (2) may begin to rotate and lift up due to the fact that the rotating stop member (9) is able to roll along the first curved area (10). When the lifting arm (2) has rotated to a certain point at which the rotating stop member (9) passes beyond the step (8) and loses contact with the lever member (5), the spring (13) causes the lever member (5) to turn in a locking direction (B) and the rotating stop member (9) to jump to the second curved area (11) (while making a subsequent 'click' sound) and continue rolling along it. If the user stops acting on the operating lever or if a hydraulic fault occurs after the rotating stop member (9) has jumped the step (8), the lifting arm (2) descends until the rotating stop member (9) reaches the step (8) and is supported on it. In this position, shown in FIG. 2, the lifting arm (2) is lodged or locked. In order to unlock it the user must act on the operating lever to raise the lifting arm (2) slightly. The user must then act on the lever member (5) so that it tilts in the unlocking direction (A) until the rotating stop member (9) is able to jump the step (8), and once more support itself and roll along the first curved area (10). When this occurs the lifting arm (2) becomes dislodged or unlocked.

Preferably, the operable area (7) of the lever member (5) may be directly accessed from the outside of the main body (12) to allow a user of the hydraulic jack (1) to operate it. The fact that said operable area (7) is designed to be foot-operated, as shown in the figures, is especially advantageous. This allows the user to use their hands to act on the lever that operates the lifting arm (2) and, at the same time, use their foot to operate the lever member (5) related with the locking function.

The invention claimed is:

1. A hydraulic jack (1) comprising:

a main body (12);

a lifting arm (2), the lifting arm (2) being articulated in relation to the main body (12) and operated hydraulically, the lifting arm (2) comprising a pusher end (3) designed to be raised while pushing a vehicle in an ascending direction, characterised in that:

a lever member (5) that may rotate in relation to the main body (12) in a locking direction (B) or in an unlocking direction (A) and which is operated by a spring (13) in the locking direction (B), where the lever member (5) presents an operable area (7) on one end to allow the lever member to be rotated in the unlocking direction (A) and a first curved area (10) and a second curved area (11) on the other end, both of them separated by a step (8), wherein the lifting arm (2) comprises a rotating stop member (9) configured to roll along the first curved area (10) or the second curved area (11) when the lifting arm (2) rotates, and which lodges itself in the step (8) to lock the lifting arm (2) and prevent the lifting arm from rotating in a descending direction.

2. The hydraulic jack (1) according to claim 1, wherein the operable area (7) may be directly accessed from the outside of the main body (12) to allow a user of the hydraulic jack (1) to operate the operable area (7).

3. The hydraulic jack (1) according to claim 1, wherein the operable area (7) may be accessed from the outside of the main body (12) to allow the user to operate operable area (7) with a foot.

* * * * *